United States Patent [19]

Hodsdon et al.

[11] 3,969,728

[45] July 13, 1976

[54] STRIPLINE ANTENNA SWITCH

[75] Inventors: Roy F. Hodsdon; Jerry M. Barringer, both of Lynchburg, Va.

[73] Assignee: General Electric Company, Lynchburg, Va.

[22] Filed: Sept. 24, 1975

[21] Appl. No.: 616,261

[52] U.S. Cl. ..... 343/702; 343/876

[51] Int. Cl.[2] ..... H01Q 1/24

[58] Field of Search ..... 343/702, 725, 853, 876

[56] References Cited

UNITED STATES PATENTS 3,087,117 4/1963 Mitchell ..... 343/702

*Primary Examiner*—Eli Lieberman

*Attorney, Agent, or Firm*—James J. Williams

[57] ABSTRACT

The circuit of a portable, two-way radio is selectively connected to an antenna mounted on the radio or to an external antenna by a stripline switch. The switch has a metallic ground plate mounted on the radio, an insulating strip mounted on the ground plate, and a movable metallic plate mounted on the insulating strip. The movable plate is permanently connected to the mounted antenna, and is moved by an insulating plunger. The movable plate movably engages a pin terminal which is connected to the radio circuit and which passes through the housing of the radio for connection to an external antenna connector. When the external antenna is to be connected to the radio circuit, a plug with an external antenna contact is attached to the housing. The plug antenna contact engages the pin terminal connected to the radio circuit. A projection on the plug moves the insulating plunger which in turn moves the movable plate away from the pin terminal to disconnect the mounted antenna from the radio circuit.

3 Claims, 5 Drawing Figures

STRIPLINE ANTENNA SWITCH

BACKGROUND OF THE INVENTION

Our invention relates to a stripline antenna switch, and particularly to a stripline antenna switch that permits a radio circuit of a portable radio to be selectively connected to an antenna mounted on the portable radio or to an external antenna.

Many portable radios, particularly transceivers, carry an antenna mounted on the cabinet or housing of the radio. Such a mounted antenna is quite convenient and is essential to make the radio truly portable. However, there are times when the radio must be connected to an external antenna, such as when the radio is used in an automobile, or in a building, or under some condition which renders the mounted antenna ineffective.

Accordingly, a primary object of our invention is to provide a new and improved antenna switch that permits the radio circuit of a portable radio to be readily connected to an external antenna.

At first consideration, it would appear that an external antenna could simply be connected to the radio circuit of a portable radio by a clip connected to the mounted antenna. However, such a connection is not workmanlike or reliable. In addition, such a connection effectively presents two antenna circuits in parallel to the radio circuit, and thus causes an impedance mismatch.

Accordingly, another object of our invention is to provide a new and improved antenna switch that permits an external antenna to be easily connected to the circuit of a portable radio and that also disconnects the mounted antenna of the radio from the radio circuit so as to maintain proper impedance relations.

SUMMARY OF THE INVENTION

Briefly, these and other objects are achieved in accordance with our invention by a stripline switch having a metallic ground plate mounted on the interior surface of a radio cabinet. An insulating strip is mounted on the ground plate, and a movable metallic plate is mounted on the insulating strip. The movable plate is connected to the mounted antenna. An insulating plunger is movably mounted in the radio cabinet for operating the movable plate. The movable plate engages a pin terminal that passes through the radio cabinet for connection to an external antenna. The pin terminal is connected to the radio circuit so that the arrangement as described thus far, provides a stripline connection from the mounted antenna through the movable plate and pin terminal to the radio circuit. When an external antenna is to be connected, a plug having a metallic contact connected to the external antenna is fastened to the cabinet so that the plug contact engages the pin terminal. The plug also carries a projection which engages the insulating plunger in the cabinet and moves the plunger against the movable plate to separate the movable plate from the pin terminal, and thereby disconnect the mounted antenna from the radio circuit.

BRIEF DESCRIPTION OF THE DRAWING

The subject matter which we regard as our invention is particularly pointed out and distinctly claimed in the claims. The structure and operation of our invention, together with further objects and advantages, may be better understood from the following description given in connection with the accompanying drawing, in which:

DESCRIPTION OF A PREFERRED EMBODIMENT

Figure 2:
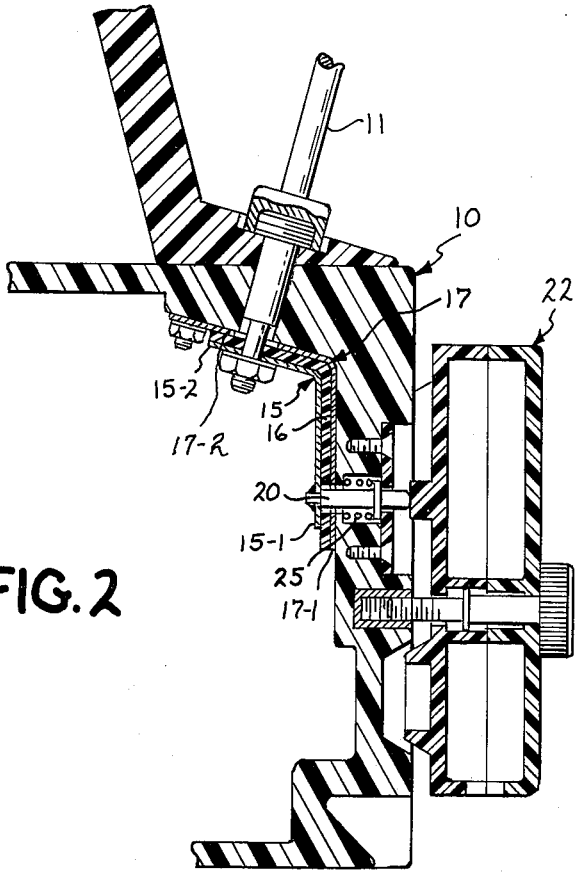
FIGS. 2 and 3 are cross-sectional views taken along the lines A—A of FIG. 1 showing our antenna switch in two operated positions.
Figure 1:
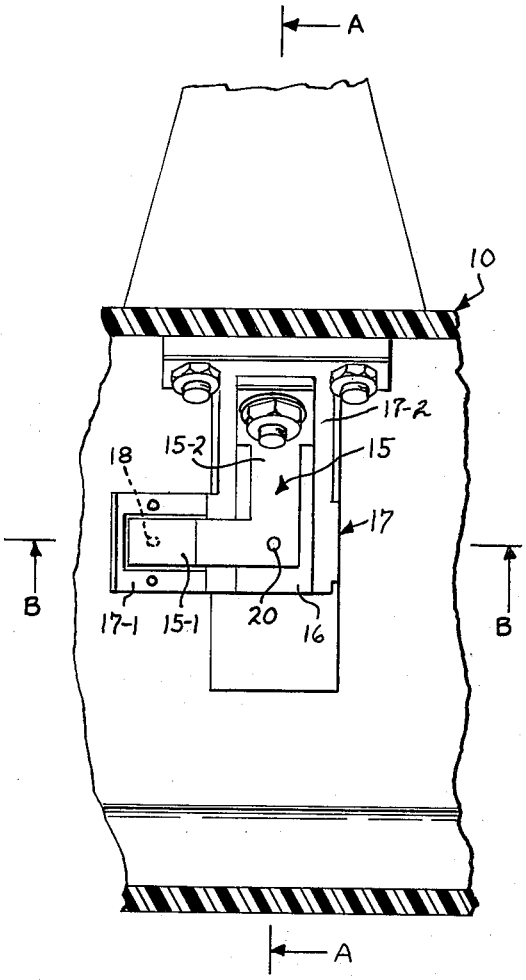
FIG. 1 is a plan view of a stripline antenna switch in accordance with our invention.
Figure 4:
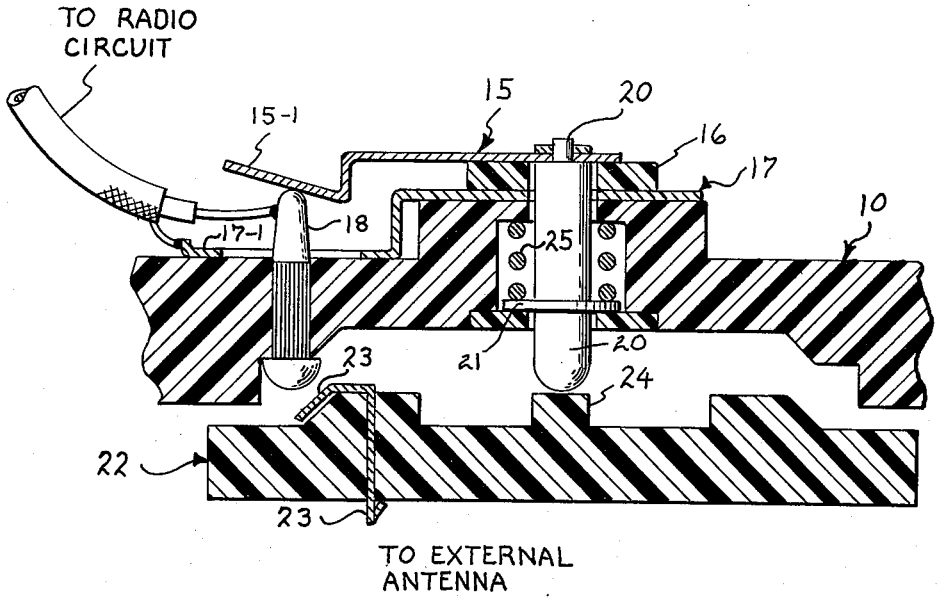
FIGS. 4 and 5 are cross-sectional views taken along the lines B—B of FIG. 1 showing our antenna switch in the two operated positions corresponding to FIGS. 2 and 3 respectively.

In the figures to be described, we contemplate that our stripline antenna switch is used with a portable transceiver which is contained in a suitable cabinet such as a plastic cabinet 10 partly shown in the figures. It will be understood that our antenna switch can be used with almost any type of radio, the transceiver 10 being a typical example. In such a transceiver, the frequencies are relatively high, in the order of 900 MHz, so that impedances are relatively important and critical. Such impedances are provided by what is called stripline construction which is what we intend our antenna switch to be used in. As shown in FIGS. 1 and 2, our antenna switch is mounted on the interior of the cabinet 10, so as to protect the switch, particularly its movable parts. The radio or transceiver partly shown in the figures has a mounted antenna 11 which is fastened by any suitable means, such as a threaded screw and nut. Our switch is provided with suitable stripline characteristics by a metallic ground plate 17 that is preferably mounted directly on the interior surface of the cabinet 10, by an insulating strip 16, mounted on the ground plate 17, and by a movable metallic plate 15 mounted on the insulating strip 16. The movable plate 15 is made of a resilient conductive metal such as phosphor bronze. The antenna 11 passes through a hole in the ground plate 17, through the insulating strip 16, and through the movable plate 15, and is connected to the movable plate 15 by the threaded nut. As seen in FIG. 1, the movable plate 15 has a movable portion 15-1 which extends at a right angle to a fixed portion 15-2 which is in contact with the antenna 11. This movable portion 15-1 normally engages a metallic pin terminal 18 which is positioned beneath the portion 15-1 and which extends through the wall of the cabinet 10 for connection to an external antenna. The metallic ground plate 17 is fixed and has a portion 17-1 which is also at a right angle to the portion 17-2 of the plate 17 in the vicinity of the antenna connection. This portion 17-1 has a relatively large opening that is substantially rectangularly shaped and through which the pin terminal 18 passes without touching. The portion 17-1 is shaped to provide the proper impedance relation between the portons 15-1, 17-1. portions spring loaded, insulating plunger 20 is movably mounted in the wall of the cabinet 10. The plunger 20 has a free end which extends beyond the exterior of the wall of the cabinet 10, passes through the wall to the interior of the cabinet 10, through the ground plate 17, through the insulating strip 16, and is attached to the movable plate 15. As shown in FIG. 4, the plunger 20 may be movably retained by an oversized collar 21. A compression spring 25 presses against the collar 21 to urge the plunger 20 down or in a normal position. In FIGS. 2 and 4, we show our antenna switch in its normal position. In this condition, the portion 15-1 of the movable metallic plate 15 engages the pin terminal 18. The pin terminal 18 is connected to the radio circuit within the cabinet 10 through a suitable coaxial line having the same impedance as the stripline switch. The inner conductor of the coaxial line is connected to the pin terminal 18, and the outer conductor of the coaxial line is connected to the portion 17-1 of the ground plate 17. In this condition, the mounted antenna 11 is connected to the radio circuit in the cabinet 10 through a stripline configuration having the desired impedance at the radio frequencies used.

Figure 3:
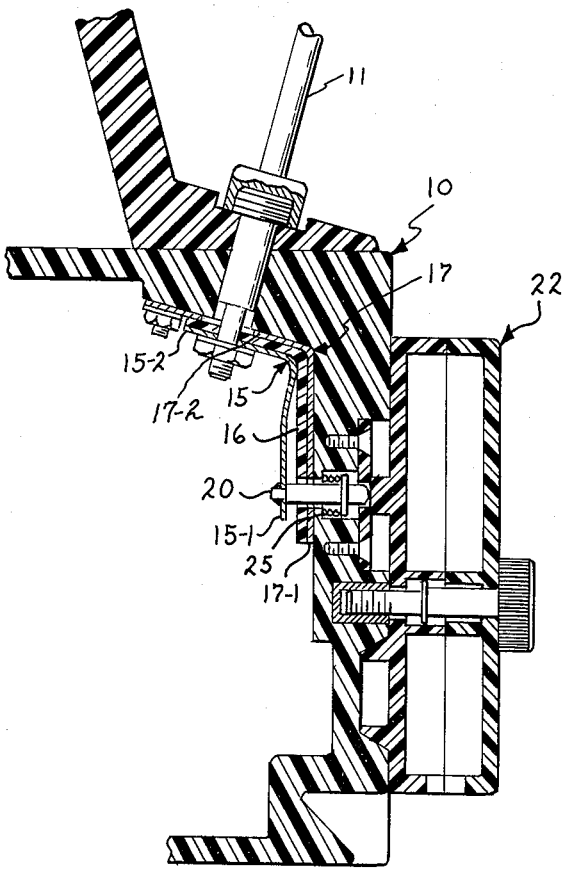
Figure 5:
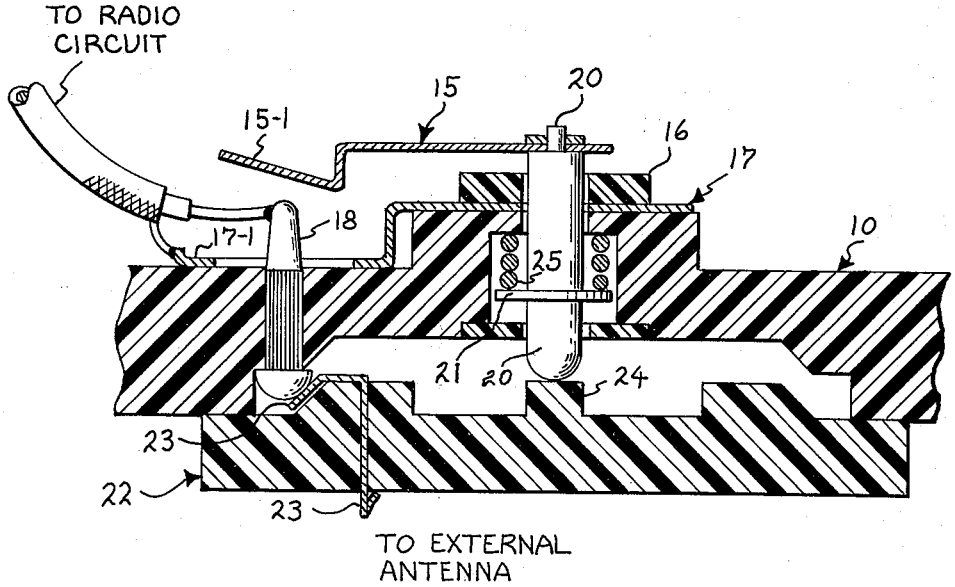

As mentioned, there are occasions when the mounted antenna 11 on the cabinet 10 does not perform satisfactorily, particularly when the radio is used in an automobile, or in a building, or in some location which prevents or shields the radio from sending or receiving signals. In this situation, it is desirable that an external antenna, such as located on the roof of a car or building, be connected to the radio circuit and that the mounted antenna 11 be disconnected from the radio circuit. In accordance with our invention, this connection is made by any suitable plug or connector 22 having an external antenna contact 23. When this connection is to be made, the plug 22 is brought up to the cabinet 10 as shown in FIGS. 2 and 4. The plug 22 carries a boss or projection 24 which is located to hit or engage the movable insulating plunger 20, as shown in FIG. 4. The plug 22 carries at least the one contact 23 which is connected to the external antenna. As the plug 22 is moved closer to the cabinet 10, the boss or projection 24 does engage the plunger 20 and moves the plunger 20 upward as viewed in FIG. 5 to compress its spring 25 or other mechanical biasing. As the plunger 20 moves upward, it carries the movable metallic plate 15 with it, so that the portion 15-1 is moved away from the pin terminal 18 as seen in FIG. 5. FIG. 3 shows how the movable plate 15 is bent near its portion 15-2 connected to the mounted antenna 11. At the same time that the plug 22 is brought near the cabinet, its antenna contact 23 engages the pin terminal 18 so that firm metallic connection is made between the contact 23 and the pin terminal 18. Thus, when the plug 22 is in the position shown in FIGS. 3 and 5, the mounted antenna 11 is disconnected from the pin terminal 18, and the external antenna is connected to the radio circuit through the plug contact 23, the pin terminal 18, and the coaxial line leading to the radio circuit. The plug 22 may be secured to the cabinet 10 by any suitable means, such as the threaded handscrew shown in FIGS. 2 and 3.

It will thus be seen that we have provided a new and improved stripline antenna switch which is particularly useful and reliable to provide good connections and impedance relations at radio frequencies. While we have shown only one embodiment, persons skilled in the art will appreciate that a number of modifications may be made. For example, the movable metallic plate 15 may have a flat surface throughout its portion 15-1 instead of the two bends as shown in FIGS. 4 and 5. However, we have found that these two bends in the portion 15-1, one forming an angle of 90 degrees and one forming an angle of approximately 75 degrees, provide the desired amount of flexing and wiping between the portion 15-1 and the pin terminal 18. Similarly, while we contemplate that our metallic ground plate 17 have a rectangular opening at the portion 17-1, other shaped openings can be used if the desired impedances are provided. Also, the movable plunger

20 may have various configurations and shapes, as long as it is slidably retained within the wall of the cabinet 10. We prefer that the plunger 20 be urged downward as viewed in FIGS. 4 and 5 by the compression spring 25, although other mechanical biasing arrangements can be used. Other types of contacts can be used on the plug 22 in place of the contact 23, as long as reliable connections are provided. And finally, the plug 22 can be suitably attached to the cabinet 10 by any suitable means other than the handscrew shown in FIGS. 2 and 3. Therefore, while our invention has been described with reference to a particular embodiment, it is to be understood that modifications may be made without departing from the spirit of the invention or from the scope of the claims.

What we claim as new and desire to secure by Letters Patent of the United States is:

1. For use in a portable radio or the like housed in a cabinet having an antenna mounted thereon, an improved stripline switch for selectively connecting a circuit of said radio to said mounted antenna or to an external antenna, said switch comprising:

a. a wall adapted to be part of the radio housing, said wall having a first opening therethrough;

b. a first metallic plate having a first portion with a first opening therethrough and having a second portion with a second opening therethrough;

c. means mounting said first plate on an interior surface of said wall with said first opening of said first plate substantially coinciding with said first opening of said wall;

d. a pin terminal mounted on said interior surface of said wall and within said second opening of said first plate, said pin terminal being spaced from the edges of said second opening of said first plate and extending above said first plate in one direction and extending in the opposite direction through said wall to the outer surface thereof;

e. an electrical insulating plate having a first opening therethrough;

f. means mounting said electrical insulating plate on at least said first portion of said first plate with said first opening of said insulating plate substantially coinciding with said first opening of said first plate and with said first opening through said wall;

g. a second metallic plate;

h. means mounting said second metallic plate on said electrical insulating plate so that said second metallic plate is electrically insulated from said first metallic plate and is in movable contact with said pin terminal;

i. an insulated plunger connected to said second metallic plate and extending through said first opening of said insulating plate, said first opening of said first plate, and said first opening of said wall, said insulated plunger being mechanically urged from said second metallic plate toward said wall;

j. means for connecting said second metallic plate to an antenna mounted on said radio;

k. means for connecting said pin terminal to the circuit of said radio apparatus;

l. and an external plug adapted to be attached to said outer surface of said wall, said plug having at least one electrical contact positioned to engage said pin terminal and having an insulated boss adapted to engage said insulated plunger, whereby when said external plug is attached to said outer wall surface, electrical contact is made between said electrical contact of said plug and said pin terminal, and said second metallic plate is moved to break electrical contact between said pin terminal and said second metallic plate.

2. In a portable radio having a housing, an antenna mounted on said housing, and a radio circuit located within said housing, an improved stripline switch for selectively connecting said radio circuit to said mounted antenna or to an external antenna comprising:

a. a metallic ground plate mounted on an interior surface of said housing, said ground plate having an opening therethrough;

b. an insulating plate mounted on said ground plate;

c. a movable metallic plate mounted on said insulating plate, said movable plate being attached at one end and extending unattached from said one end over said ground plate and said ground plate opening but spaced therefrom;

d. a conductive terminal mounted on said housing within said groundplate opening, said terminal having a first end in contact with said movable plate and extending in a second opposite direction to a second end exterior of said housing;

e. means connecting said terminal to said radio circuit;

f. means connecting said mounted antenna to said movable plate at a relatively stationary portion thereof;

g. an insulating actuator movably mounted on said housing with one end adapted to engage said movable plate between said one end and the location it contacts said terminal, and with the other end of said actuator located outside said housing in the vicinity of said terminal for being actuated;

h. and said housing adapted to receive an external connector that connects an external antenna to said second end of said terminal on the exterior of said housing and that contacts and moves said insulating actuator to move said movable plate and disconnect said movable plate from said first end of said terminal.

3. The improved stripline switch of claim 2 wherein said insulating actuator is mechanically biased in a direction away from its contact with said movable plate.

* * * * *

UNITED STATES PATENT OFFICE

CERTIFICATE OF CORRECTION

Patent No. 3,969,728 Dated July 13, 1976

Inventor(s) Roy F. Hodsdon; Jerry M. Barringer

It is certified that error appears in the above-identified patent and that said Letters Patent are hereby corrected as shown below:

Column 2, line 56, cancel "portons" and insert -- portions -- line 56, cancel "portions" (second occurrence) and insert -- A --

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*